US009447649B2

(12) United States Patent
Doane et al.

(10) Patent No.: US 9,447,649 B2
(45) Date of Patent: Sep. 20, 2016

(54) PACKER SETTING MECHANISM

(71) Applicants: James C. Doane, Friendswood, TX (US); Robert J. Taylor, Houston, TX (US); Peter J. Fay, Houston, TX (US); David B. Ruddock, Houston, TX (US); Scott D. Collins, Houston, TX (US); Rafael Ramirez, Houston, TX (US); Gary L. Anderson, Humble, TX (US)

(72) Inventors: James C. Doane, Friendswood, TX (US); Robert J. Taylor, Houston, TX (US); Peter J. Fay, Houston, TX (US); David B. Ruddock, Houston, TX (US); Scott D. Collins, Houston, TX (US); Rafael Ramirez, Houston, TX (US); Gary L. Anderson, Humble, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 478 days.

(21) Appl. No.: 13/911,600

(22) Filed: Jun. 6, 2013

(65) Prior Publication Data

US 2014/0360734 A1 Dec. 11, 2014

(51) Int. Cl.

| | |
|---|---|
| ***E21B 23/06*** | (2006.01) |
| ***E21B 33/128*** | (2006.01) |
| ***E21B 33/127*** | (2006.01) |
| *E21B 33/12* | (2006.01) |

(52) U.S. Cl.

CPC ..... *E21B 23/06* (2013.01); *E21B 33/1272* (2013.01); *E21B 33/1285* (2013.01); *E21B 33/12* (2013.01); *E21B 33/128* (2013.01)

(58) Field of Classification Search

CPC .. E21B 33/12; E21B 33/128; E21B 33/1285; E21B 23/06

USPC ..... 166/387

See application file for complete search history.

(56) References Cited

U.S. PATENT DOCUMENTS

| | | | | |
|---|---|---|---|---|
| 6,779,600 | B2 * | 8/2004 | King | E21B 33/1295 166/118 |
| 2005/0205269 | A1 * | 9/2005 | Kilgore | E21B 23/06 166/387 |
| 2008/0066931 | A1 * | 3/2008 | Xu | E21B 23/065 166/381 |
| 2010/0252252 | A1 * | 10/2010 | Harris | E21B 23/01 166/118 |
| 2012/0160521 | A1 | 6/2012 | McGlothen et al. | |

OTHER PUBLICATIONS

Weatherford, [online]; [retrieved on Aug. 6, 2013]; retrieved from the Internet http://www.weatherford.com/weatherford/groups/web/documents/weatherfordcorp/www019166.pdf, "OptiSet Packer Setting Valve", Weatherford.com, 2006-2010 Weatherford; 3 pages.

* cited by examiner

*Primary Examiner* — Nicole Coy
*Assistant Examiner* — Tara Schimpf
(74) *Attorney, Agent, or Firm* — Cantor Colburn LLP

(57) ABSTRACT

A packer system including a packer and a setting mechanism. The setting mechanism has a setting piston that is actuatable in response to a fluid pressure in order to set the packer with the setting piston. The setting mechanism prevents actuation of the setting piston until the pressure is decreased below a threshold pressure from a value greater than the threshold pressure. A method of setting a packer is also included.

17 Claims, 5 Drawing Sheets

PACKER SETTING MECHANISM

BACKGROUND

Packers are ubiquitous in the downhole drilling and completions industry. Packers come in a variety of styles and with a variety of setting mechanisms. For example, inflatable, compressible, swellable, and other types of packers are known and can be actuated via mechanical, hydraulic, electric, or other power types. Due at least in part to their prevalence in completion systems, the industry always desires new and alternate packers and packer setting mechanisms.

SUMMARY

A packer system, including a packer; a setting mechanism having a setting piston that is actuatable in response to a fluid pressure in order to set the packer with the setting piston, the setting mechanism preventing actuation of the setting piston until the pressure is decreased below a threshold pressure from a value greater than the threshold pressure.

A setting mechanism for actuating a tool due in response to a hydrostatic pressure of a fluid in a borehole structure including a setting piston that is prevented from actuating until the hydrostatic pressure exerted on the setting mechanism is decreased below a threshold pressure from a value greater than the threshold pressure.

A method of setting a packer with a setting mechanism including applying a pressure to the setting mechanism; enabling actuation of the setting piston of the setting mechanism only after the pressure is decreased below the threshold pressure from a value greater than the threshold pressure; and actuating the setting piston with the pressure to set the packer.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
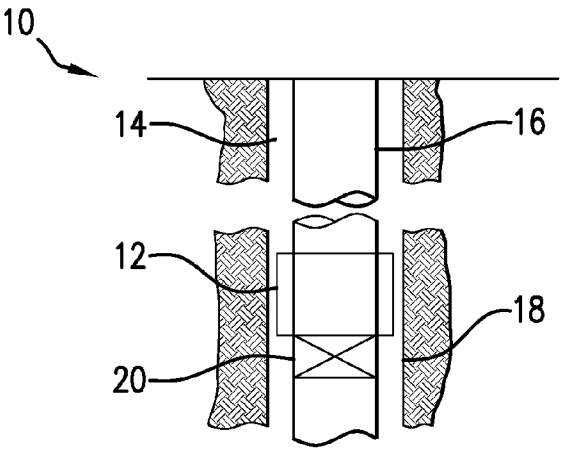
FIG. 1 schematically illustrates a completion system having a packer actuated by a setting mechanism.

A system 10 for setting a packer 12 is schematically shown in FIG. 1. The packer 12 is arranged to impede fluid communication through an annulus 14, e.g., by radially outwardly extending and sealingly engaging between an inner string 16 and an outer borehole structure 18. For example, the inner string 16 can be any completion string, e.g., a production string, desired to be run downhole and the outer structure 18 can be an open hole borehole, a cased borehole, an outer tubular string in a borehole, etc. The system 10 includes a setting mechanism 20 for controlling operation of (i.e., setting) the packer 12. As will be better appreciated in view of the below, the setting mechanism 20 can be used for setting other tools via hydrostatic pressure.

Figure 2:
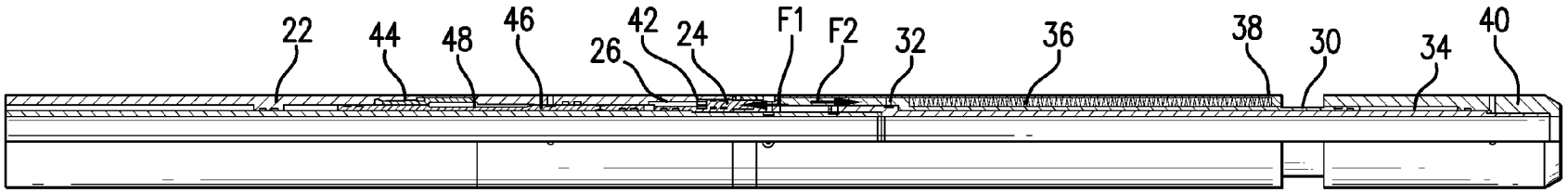
FIGS. 2, 3, 4, 5, and 6, are quarter-sectional illustrations showing the setting mechanism of FIG. 1 in various stages of operation to set the packer.

The setting mechanism 20 according to one embodiment is shown in various stages of operation for setting the packer 12 throughout FIGS. 2-6. Referring first to FIG. 2, the system setting mechanism 20 is depicted in an initial or run-in configuration in which the packer 12 (not shown in FIGS. 2-6) is not set. In the initial configuration of FIG. 2, the setting mechanism is in a closed state such that fluid communication between the annulus 14 and a piston 22 for the packer 12 is not permitted. Namely, the setting mechanism 20 includes a plug or valve member 24 that is sealingly disposed along a fluid pathway 26 connecting the annulus 14 to the setting piston 22. As discussed in more detail below, when the plug 24 opens, fluid communication can be permitted via the pathway 26 to the piston 22 in order to actuate the piston 22 and set the packer 12 with a pressure of the fluid in the annulus 14.

Figure 3:
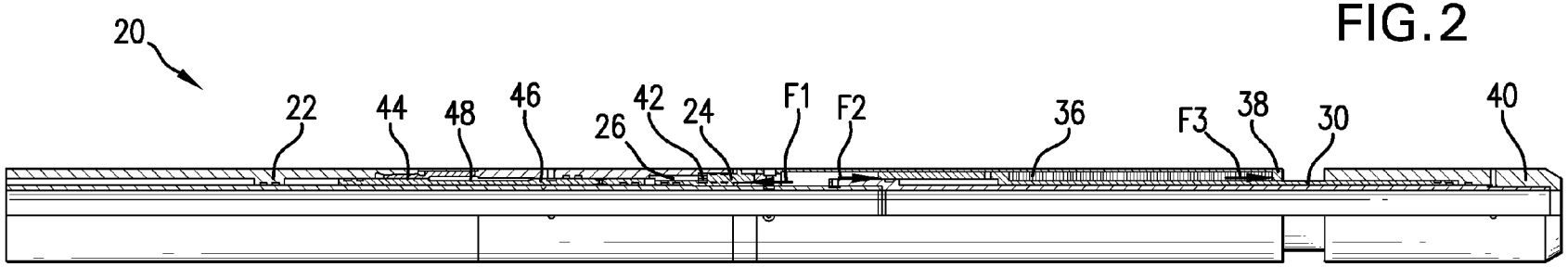
Figure 2A:
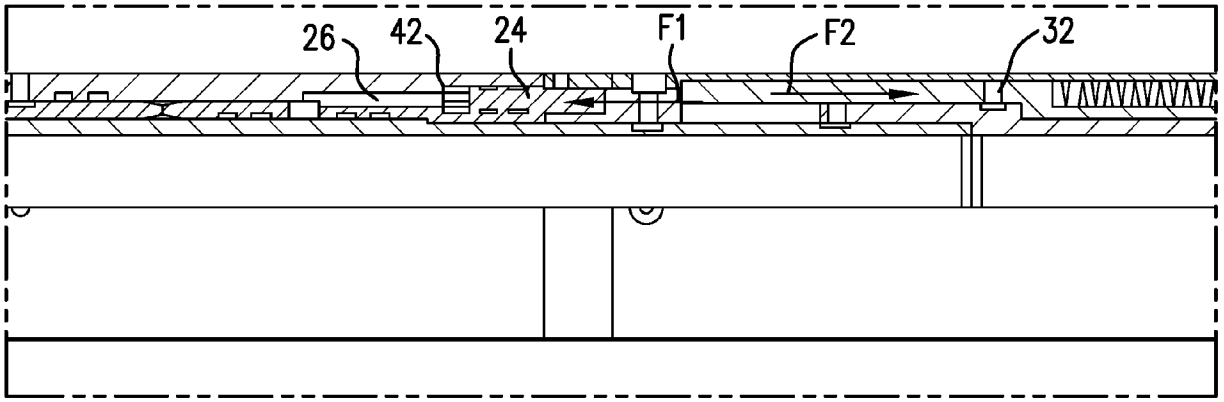
FIGS. 2A, 3A, 4A, 5A, and 6A are zoomed in perspectives from respective FIGS. 2, 3, 4, 5, and 6.
Figure 3A:
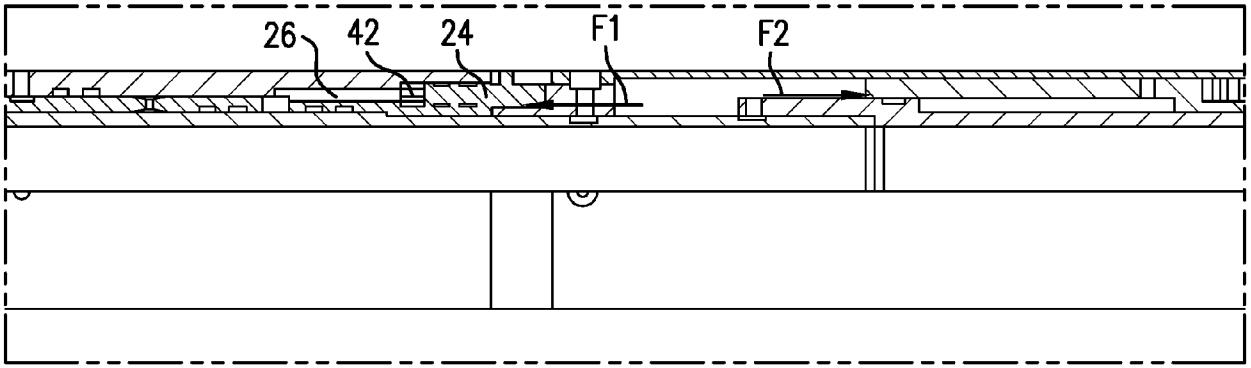

Fluid pressure of in the annulus 14 exerts a force F1 on the plug 24 and a force F2 on a priming piston 30. If desired, a shear screw or other release member 32 can be included for preventing movement of the piston 30 until the force F2 exceeds a predetermined or preselected minimum threshold. Examples of other release members that can be alternatively used include collets, latches, dogs, magnetic couplings, shear rings, resilient c-rings or split rings, etc. The force F2 is created due to a pressure differential across the piston 30 that results from a relatively low pressure chamber 34, e.g., atmospheric pressure, which is sealed off from the hydrostatic pressure of the fluid in the annulus 14. Movement of the piston 30 compresses a resilient member 36 against a sleeve 38. The sleeve 38 is coupled or attached to the plug 24, such that movement of the sleeve 38 can dislodge the plug 24 from the pathway 26. The resilient member 36 could be any resilient, spring-like, elastically deformable, or other element capable of storing energy or creating or transferring a biasing force F3 on the sleeve 38 due to movement of the piston 30. In the configuration of FIG. 3, the release members 32 have been released (e.g., shear screws are sheared) enabling the piston 30 to bottom out against an end cap 40 of the setting mechanism, thereby loading the resilient member 36 to exert the force F3.

Figure 4:
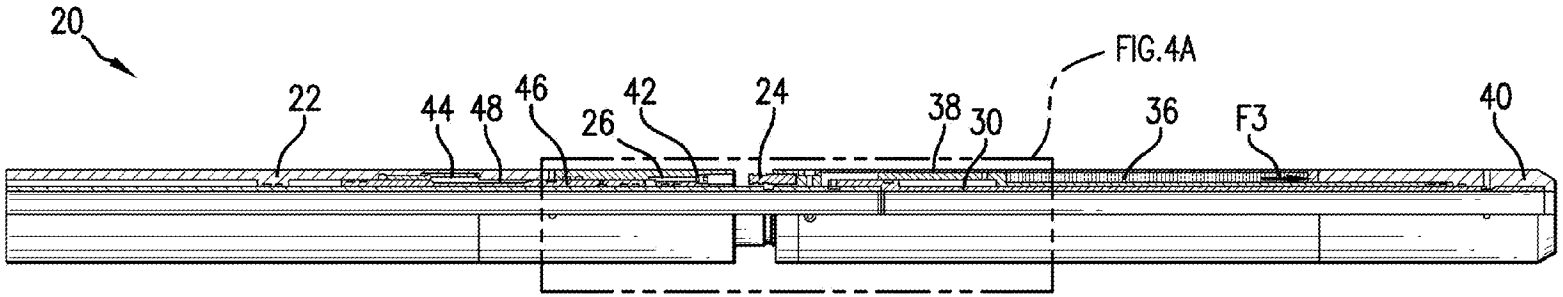
Figure 5:
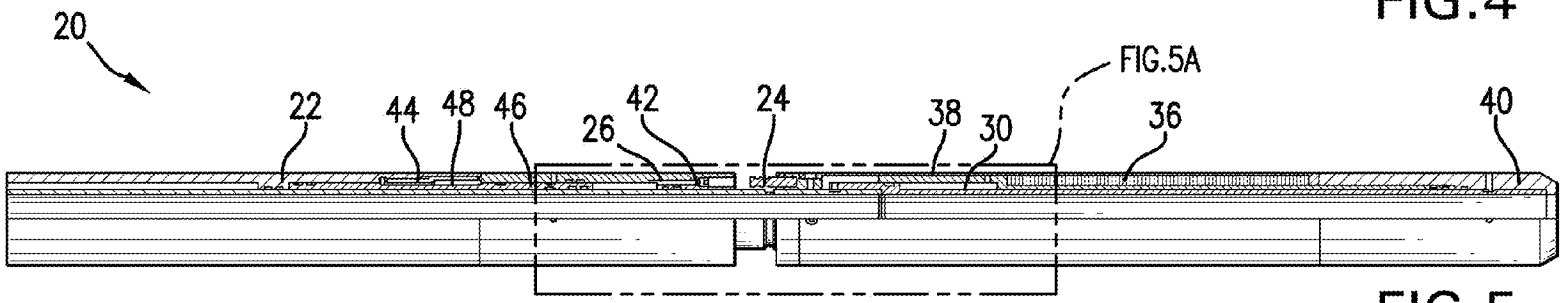
Figure 6:
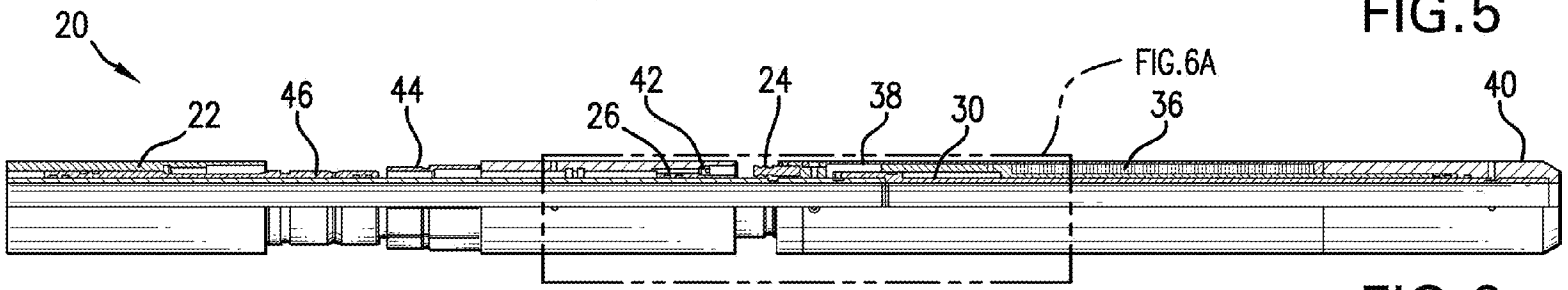
Figure 4A:
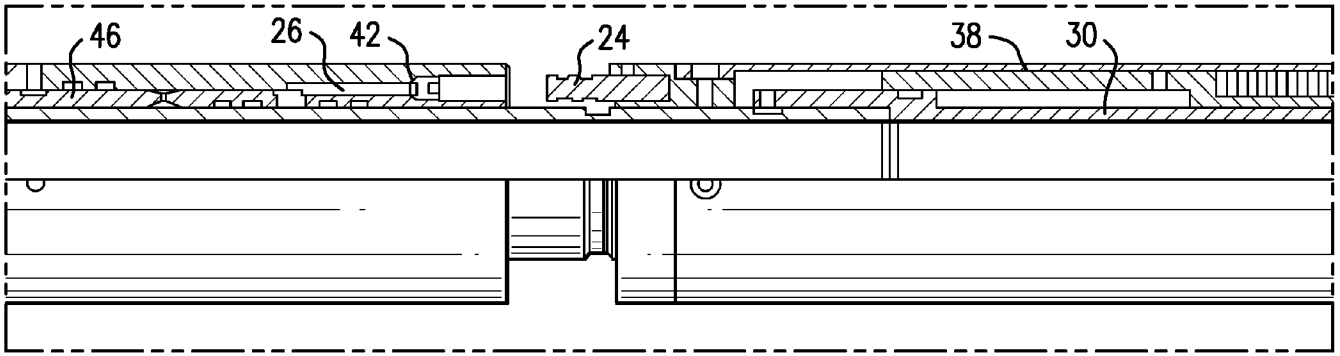
Figure 5A:
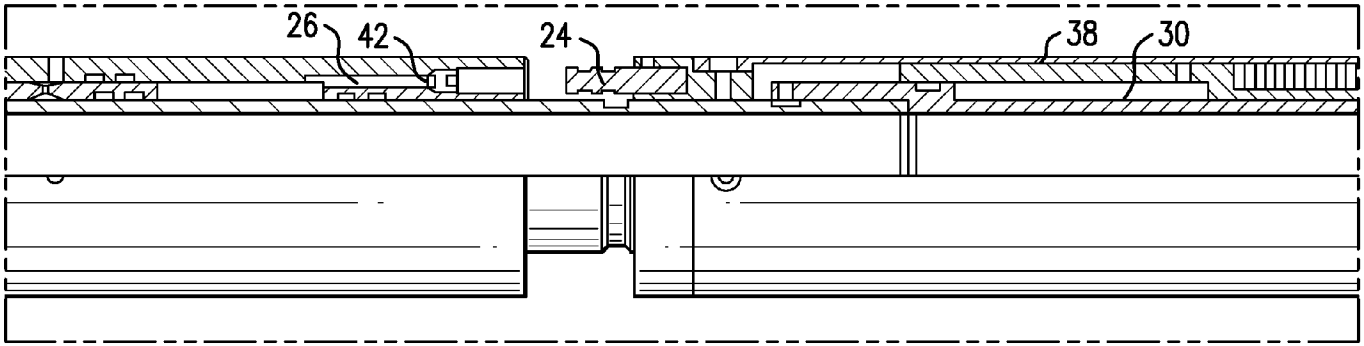
Figure 6A:
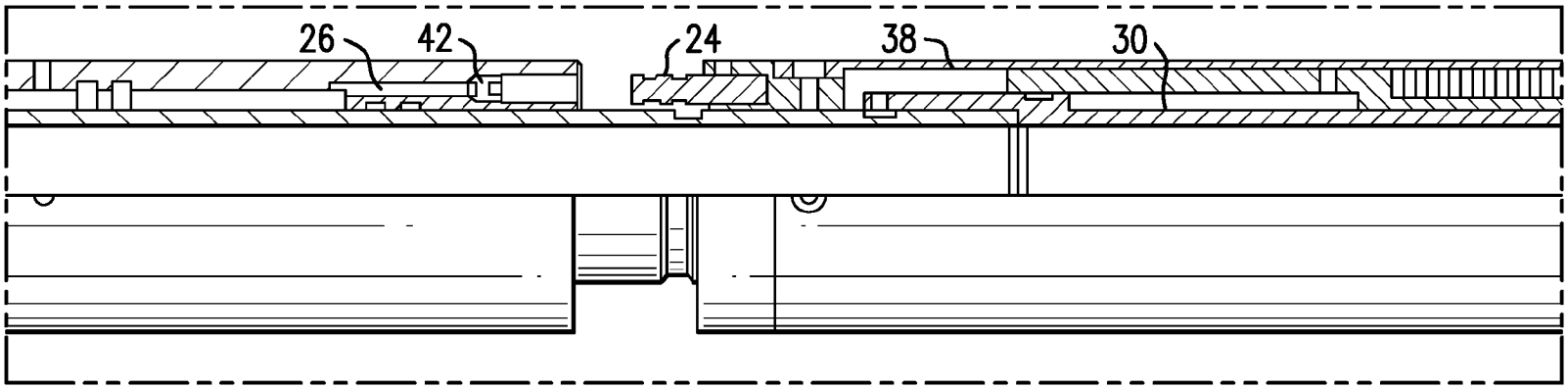

Further increasing the pressure in the annulus 14 will not cause disengagement of the plug 24. Instead, the pressure in the annulus 14 must be relieved or dropped below a predetermined or preselected threshold pressure. The threshold pressure can be set approximate at the point where the force F1 is equal to the force F3. In this way, lowering the pressure in the annulus 14 below the threshold pressure will result in the force F3 exceeding the force F1. As shown in FIG. 4, when the force F3 exceeds the force F1, the sleeve 38 will be shifted to disengage the plug 24 from the pathway 26, enabling direct fluid communication of the pathway 26 with pressure in the annulus 14.

A pressure drop to open the plug 24 can be achieved by replacing the fluid in the annulus 14 with a relatively lower density fluid. For example, it is typical in borehole completion processes to first fill the borehole annulus, e.g., the annulus 14, with a relatively high density heavy-weight or kill-weight fluid. This kill-weight fluid is often later replaced with a relatively less dense or "lighter" packer fluid. The use of the relatively lighter packer fluid reduces the hydrostatic pressure in the annulus, e.g., the annulus 14, with respect to the hydrostatic pressure resulting from the kill-weight fluid. For example, a kill-weight fluid may correspond to a pressure at the setting mechanism 20 of approximately 25,000 psi, while a packer fluid may correspond to a pressure at the setting mechanism 20 of only about 13,000 psi. Traditional packers require an actuation pressure exceeding that related to of the kill-weight fluid, e.g., in the order of 25,000 psi, in order to be set. Pressures at these high levels can have adverse effects, e.g., damaging other components of the completion. Additionally, it is noted that the pressures exerted by these kill-weight fluids will exceed the pressure required to ultimately set the packer 12 or other tool. For this reason, it can be difficult or costly to manufacture a rupture disk or other temporary fluid flow impeding element that can resist such high pressures. Advantageously, the setting mechanism 20 prevents actuation of the packer 12 or other tool until the pressure drops below the aforementioned threshold pressure, thereby avoiding the need to reach pressures even greater than that exhibited by kill-weight fluid.

Once the plug 24 is opened, fluid pressure can be communicated to shift the setting piston 22 and set the packer 12. Alternatively, the setting mechanism 20 can include a temporary impeding element 42, which in the illustrated embodiment takes the form a rupture disk. The temporary impeding element 42 can be included to prevent fluid communication between the piston 22 and the annulus 14 until some predetermined condition is met. In embodiments in which the element 42 takes the form of a rupture disk, fluid communication between the piston 22 and the annulus 14 is enabled when pressure in the annulus 14 reaches or exceeds a corresponding threshold. For example, referring back to the above described example embodiment, the rupture disk may be configured to burst at an intermediate pressure between the hydrostatic pressure of the hydro kill-weight fluid at the setting mechanism and that of the lighter packer fluid that replaces the kill-weight fluid. Thus, even if a rupture disk or other pressure responsive temporary impeding element is used, the pressure to set the piston 12 can still be set by the setting mechanism 20 to be less than that related to heavy-weight or kill-weight fluid.

In the illustrated embodiment, the piston 22 is initially immovably held in place by a collet 44. In order to release the collet 44, which in turn enables shifting of the piston 22 to set the packer 12, the fluid pressure communicated via the pathway 26 is used to shift a sleeve, piston, or other support member 46 in order to align a recessed or radially restricted portion 48 of the support member 46 with the collet 44. The collet 44 is unsupported when aligned with the portion 48 and permits the fingers of the collet 44 to flex radially inwardly and release the piston 22. Alternatively to the illustrated arrangement, the fluid pressure communicated through the pathway 26 can be directly applied to shift the piston 22. It is additionally noted that the collet 44 can be replaced in other embodiments by one or more other release members, e.g., shear screws, dogs, etc., similar to the release members 32 discussed above.

It is to be appreciated that the temporary impeding element 42 can take forms other than a rupture disk that are or are not openably responsive to pressure. For example, the element 42 in one embodiment is a plugging element that is held in place by a shear screw or ring, one or more retractable dogs, a collet, latch, ratcheting, etc., that must be displaced via the application of a suitable force, via the pressure in the annulus 14, to open the pathway 26. In one embodiment, the element 42 is made from a disintegrable material, for example, that made commercially available by Baker Hughes Incorporated under the name IN-TALLIC™. In one embodiment, the plug 24 is additionally or alternatively made of a disintegrable material. In these embodiments, the disintegrable material can be selected to be disintegrably responsive to the lighter packer fluid, or another relatively low density spacer fluid can be first supplied to the annulus 14 to remove the plug 24 and/or the temporary impeding element 42 before the packer fluid is supplied. According to one embodiment, the plug 24 is removed due to the actuation and/or movement of a sleeve or other component located along the string 16, e.g., the shifting of piston or setting component of a hydraulic set packer or the like (e.g., responsive to the heavy-weight fluid, fluid pressure internal to the string 16, etc.), with the plug 24 and/or the piston 30 being mechanically coupled to the sleeve or other component. In one embodiment, the piston 30 is hydraulically actuated due to pressure internal to the string 16 in order to open the plug 24. The resilient member 36 can optionally be included in these and other embodiments. In each embodiment, the plug 24 of the setting mechanism 20 is unresponsive to pressures in the annulus 14 above the aforementioned threshold pressure, even though it is the pressure of fluid in the annulus 14 that eventually sets the packer 12.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A packer system, comprising:

a packer;

a setting mechanism having a setting piston that is actuatable in response to a fluid pressure in order to set the packer with the setting piston;

a sleeve operably connected to the setting piston; and a resilient member operably connected with the sleeve, the resilient member providing a biasing force opposite the fluid pressure, wherein the setting mechanism prevents actuation of the setting piston until the fluid pressure is decreased below a threshold less than the biasing force.

2. The packer system of claim 1, wherein the fluid pressure includes fluid pressure in a borehole annulus.

3. The packer system of claim 1, wherein the pressure is hydrostatic pressure.

4. The packer system of claim 1, wherein the setting mechanism includes a release member preventing actuation of the setting piston until the release member is released.

5. The packer system of claim 4, wherein the release member is a collet.

6. The packer system of claim 5, wherein the collet is initially supported by a support member that is shifted to an unsupportive position relative the collet to release the setting piston.

7. The packer system of claim 4, wherein the release member is responsive to the pressure.

8. The packer system of claim 7, wherein the release member is initially isolated from the pressure by a plug.

9. The packer system of claim 8, wherein the plug is mechanically shiftable to enable fluid communication with the release member.

10. The packer system of claim 9, wherein the setting mechanism includes a priming piston that is actuatable to load the resilient member, the resilient member exerting a force to shift the plug.

11. The packer system of claim 10, wherein the priming piston is actuated by the fluid pressure.

12. The packer system of claim 8, wherein the plug is disintegrable in response to a selected fluid to enable fluid communication with the release member.

13. The packer system of claim 8, wherein the fluid pressure acts on the plug in a direction to maintain the plug in a closed configuration.

14. The packer system of claim 8, wherein the setting mechanism includes a temporary impeding element that impedes fluid communication to the release member even after the plug is opened.

15. The packer system of claim 14, wherein the temporary impeding element is responsive to the fluid pressure being greater than the threshold pressure.

16. The packer system of claim 14, wherein the temporary impeding element is a rupture disk.

17. The packer system of claim 14, wherein the temporary impeding element is disintegrable in response to a selected fluid.

* * * * *